US008152503B2

(12) United States Patent
Haller

(10) Patent No.: US 8,152,503 B2
(45) Date of Patent: Apr. 10, 2012

(54) BAFFLE MEMBER FOR SCROLL COMPRESSORS

(75) Inventor: David K. Haller, Easton, MD (US)

(73) Assignee: Tecumseh Products Company, Ann Arbor, MI (US)

( * ) Notice: Subject to any disclaimer, the term of this patent is extended or adjusted under 35 U.S.C. 154(b) by 445 days.

(21) Appl. No.: 12/484,353

(22) Filed: Jun. 15, 2009

(65) Prior Publication Data

US 2010/0021330 A1 Jan. 28, 2010

Related U.S. Application Data

(60) Provisional application No. 61/061,899, filed on Jun. 16, 2008.

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/55.5; 418/55.1; 418/57; 418/151

(58) Field of Classification Search ..... 418/55.1–55.6, 418/57, 151, 270, 94, 98, 100
See application file for complete search history.

(56) References Cited

U.S. PATENT DOCUMENTS

| | | | | |
|---|---|---|---|---|
| 4,332,535 | A | 6/1982 | Terauchi et al. | |
| 4,538,975 | A | 9/1985 | Tsukagoshi | |
| 4,623,306 | A * | 11/1986 | Nakamura et al. | 418/55.6 |
| 4,767,293 | A | 8/1988 | Caillat et al. | |
| 4,877,382 | A | 10/1989 | Caillat et al. | |
| 4,895,496 | A | 1/1990 | Elson | |
| 4,992,033 | A | 2/1991 | Caillat et al. | |
| 4,998,864 | A | 3/1991 | Muir | |
| 5,007,809 | A * | 4/1991 | Kimura et al. | 418/55.1 |
| 5,037,278 | A | 8/1991 | Fujio et al. | |
| 5,055,010 | A | 10/1991 | Logan | |
| 5,114,322 | A | 5/1992 | Caillat et al. | |
| 5,219,281 | A | 6/1993 | Caillat et al. | |
| 5,240,391 | A | 8/1993 | Ramshankar et al. | |
| 5,366,352 | A | 11/1994 | Deblois et al. | |
| 5,427,511 | A | 6/1995 | Caillat et al. | |
| 5,439,361 | A * | 8/1995 | Reynolds et al. | 418/55.6 |
| 5,772,411 | A * | 6/1998 | Crum et al. | 418/55.1 |
| 5,772,416 | A | 6/1998 | Caillat et al. | |
| 5,931,649 | A | 8/1999 | Caillat et al. | |
| 6,000,917 | A * | 12/1999 | Smerud et al. | 417/368 |
| 6,017,205 | A | 1/2000 | Weatherston et al. | |
| 6,205,808 | B1 | 3/2001 | Beekman | |
| 6,315,536 | B1 | 11/2001 | DeVore et al. | |
| 6,402,485 | B2 | 6/2002 | Hong et al. | |
| 6,474,964 | B2 | 11/2002 | De Bernardi et al. | |
| 6,807,821 | B2 | 10/2004 | Narney, II | |
| 6,896,496 | B2 * | 5/2005 | Haller et al. | 418/55.1 |
| 7,018,184 | B2 | 3/2006 | Skinner et al. | |
| 7,311,501 | B2 | 12/2007 | Wehrenberg et al. | |
| 2004/0047754 | A1 | 3/2004 | Gopinathan | |
| 2006/0245967 | A1 | 11/2006 | Gopinathan | |
| 2007/0003424 | A1 * | 1/2007 | Benco et al. | 418/55.1 |
| 2007/0183914 | A1 | 8/2007 | Gopinathan | |

* cited by examiner

*Primary Examiner* — Theresa Trieu
(74) *Attorney, Agent, or Firm* — Faegre Baker Daniels LLP

(57) ABSTRACT

A baffle member for use in scroll compressors. In one exemplary embodiment, the baffle member is attached to a portion of the crankcase and, in use, deflects lubricant that may be thrown from the thrust surface of the crankcase during operation of the compressor away from the flow of working fluid, and also aids in directing the flow of working fluid away from the thrust surface of the crankcase and toward a suction inlet in the compression mechanism.

16 Claims, 6 Drawing Sheets

BAFFLE MEMBER FOR SCROLL COMPRESSORS

CROSS-REFERENCE TO RELATED APPLICATIONS

This application claims the benefit under Title 35 U.S.C. §119(e) of U.S. Provisional Patent Application Ser. No. 61/061,899, entitled LUBRICANT BAFFLE FOR SCROLL COMPRESSORS, filed on Jun. 16, 2008, the entire disclosure of which is expressly incorporated by reference herein.

BACKGROUND

1. Field of the Invention

The present invention relates to scroll compressors and, particularly, to a baffle member for a scroll compressor.

2. Description of the Related Art

Compressors generally have mating axially or radially loaded surfaces, such as the interfacing surfaces of thrust bearings and radial bearings. For example, in a scroll compressor, the orbiting scroll member orbits upon a thrust surface that is formed as a portion of the crankcase of the compressor. These surfaces tend to experience high wear and usually require a substantial amount of lubrication. The retention of lubricant on the interfacing bearing surface is often facilitated by the use of recesses, grooves, or clearances spaces on the interfacing surface. When the compressor is operating at high speeds, some of the lubricant on the bearing surface may be thrown outwardly from the bearing surface, and there is a need to contain such lubricant.

SUMMARY

The present invention provides a baffle member for use in scroll compressors. In one exemplary embodiment, the baffle member is attached to a portion of the crankcase and, in use, deflects lubricant that may be thrown from the thrust surface of the crankcase during operation of the compressor away from the flow of working fluid, and also aids in directing the flow of working fluid away from the thrust surface of the crankcase and toward a suction inlet in the compression mechanism.

In one exemplary embodiment, the baffle member includes a body portion having an inclined surface. The body portion is positioned atop an upper surface of the crankcase, such that the body portion of the baffle member is positioned above the thrust surface of the crankcase. In one exemplary embodiment, the inclined surface of the baffle member terminates at a position that is spaced from an upper surface of the crankcase. The inclined surface of the baffle member acts to direct working fluid traveling from a suction port of the compressor over the inclined surface, away from the thrust surface of the crankcase, and toward the suction inlet of the compression mechanism, such that the working fluid substantially bypasses any lubricant that may be thrown from the thrust surface of the crankcase. As a result, lubricant that may be thrown radially outwardly from the thrust surface is prevented from being entrained in the working fluid and the efficiency of the compressor is increased.

In one exemplary embodiment, the body portion of the baffle member is positioned atop a rib of the crankcase that is adjacent to the thrust surface of the crankcase. In this embodiment, the body portion of the baffle member acts to deflect any lubricant that may be thrown from the thrust surface of the crankcase during operation of the compressor. Specifically, the body portion of the baffle member may extend to a height in an axial direction that is greater than the height of the thrust surface of the crankcase in an axial direction. As a result, the body portion of the baffle member acts as a barrier to the passage of lubricant thrown from the thrust surface of the crankcase and prevents the lubricant from entering the flow path of working fluid traveling into the compression mechanism. Stated another way, lubricant that is thrown from the thrust surface of the crankcase that would normally pass over the rib of the crankcase contacts the body portion of the baffle member instead, which deflects the lubricant.

The baffle member is also removably attached to the crankcase such that the baffle member may be selectively used with a crankcase depending on whether the added benefits of the baffle member are desirable. For example, in a variable speed compressor, the baffle member may be desirable when the compressor is operated at a relatively high speeds, in which lubricant is more likely to be thrown radially outwardly from the thrust surface. In contrast, if the compressor is a single speed compressor and is configured to operate at a relatively low speed, the baffle member may not be needed, allowing assembly of the compressor without the baffle member. This modularity reduces manufacturing costs by allowing a single crankcase design to be used with multiple compressor configurations and also decreases the overall manufacturing cost by eliminating the need to tool and manufacture crankcases of different designs.

In one form thereof, the present invention provides a vertical scroll compressor defining perpendicular axial and radial directions, including a housing having a suction port; a compression mechanism disposed within said housing and including a non-orbiting scroll having a first involute wrap and an orbiting scroll having a second involute wrap; a motor drivingly connected to said orbiting scroll; a crankcase including a thrust surface disposed at an axial thrust surface height, said thrust surface having a plurality of lubricant retaining recesses formed therein and said orbiting scroll bearingly supported on said thrust surface; and a baffle member removably positioned on said crankcase and disposed radially between said thrust surface and said suction port, said baffle member having a body portion with an upper surface disposed at an axial baffle member height, said baffle member height being greater than said thrust surface height, whereby said baffle member extends above said support surface of said crankcase.

In another form thereof, the present invention provides a vertical scroll compressor defining perpendicular axial and radial directions, including a housing having a suction port; a compression mechanism disposed within said housing and including a non-orbiting scroll having a first involute wrap and a suction inlet, and an orbiting scroll having a second involute wrap; a motor drivingly connected to said orbiting scroll; a crankcase including a thrust surface disposed at an axial thrust surface height, said orbiting scroll bearingly supported on said thrust surface; and a baffle member removably positioned on said crankcase and disposed radially between said thrust surface and said suction port, said baffle member having a body portion including an inclined surface disposed at least partially axially above said crankcase, said inclined surface positioned within a flow path of working fluid from said suction port to said suction inlet.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
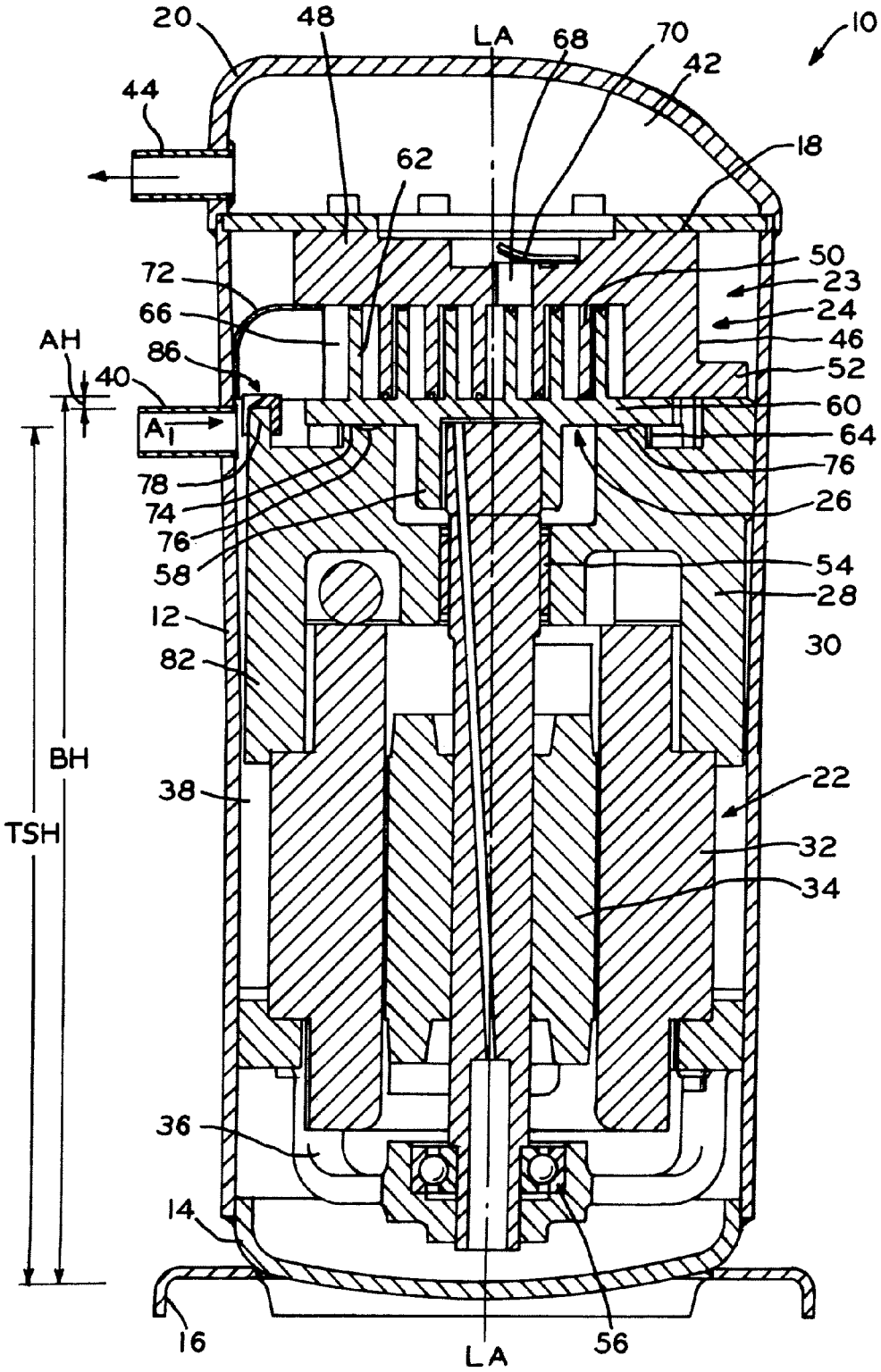
FIG. 1 is a cross-sectional view of a scroll compressor including the baffle member of the present invention.

Referring to FIG. 1, scroll compressor 10 is shown, which includes hermetic main housing 12, bottom cap 14 with base 16 secured to the lower end of housing 12, and a separator plate 18 and top cap 20 each secured to the upper end of housing 12 by a welding, brazing, or other suitable operation to define an enclosed hermetic housing in which motor 22 and compression mechanism 23 of compressor 10 are disposed. Compressor 10 is a vertical compressor generally having an axial direction along the longitudinal axis LA of crankshaft 30, and a radial direction that is perpendicular to the axial direction.

Motor 22 and compression mechanism 23 generally include first, non-orbiting scroll 24, second, orbiting scroll 26, crankcase 28, crankshaft 30, stator 32, rotor 34, and outboard bearing assembly 36. Separator plate 18 is secured around its perimeter to the interior of housing 12, such as by welding, and divides the interior of the housing 12 into a relatively low pressure suction chamber 38 that is in fluid communication with suction port 40 in housing 12, and a relatively high pressure discharge chamber 42 in fluid communication with discharge port 44 in top cap 20.

Non-orbiting scroll 24 is secured to separator plate 18, such as by a plurality of bolts, and includes outer wall 46 extending from base plate 48, and involute wrap 50 extending from base plate 48 and disposed inwardly of outer wall 46. Non-orbiting scroll 24 further includes a plurality of mount flanges 52 spaced radially about the end of outer wall 46 opposite base plate 48, and a plurality of bolts (not shown) secure mount flanges 52 to crankcase 28. Crankcase 28 includes main bearing 54 in which the upper portion of crankshaft 30 is rotatably supported. Stator 32 is fixed within housing 12 by a plurality of bolts (not shown) which pass through outboard bearing assembly 36, stator 32, and into crankcase 28. Crankshaft 30 is secured to rotor 34 in a suitable manner, and outboard bearing assembly 36 includes outboard bearing 56 which supports a lower end of crankshaft 30. The upper portion of crankshaft 30 includes an eccentric end mounted within annular hub 58 extending downwardly from base plate 60 of orbiting scroll 26. Orbiting scroll 26 additionally includes involute wrap 62 extending upwardly from base plate 60 thereof, which is in meshing relationship with wrap 50 of non-orbiting scroll 24. Oldham coupling 64 is operatively coupled between orbiting scroll 26 and crankcase 28 to prevent rotation of orbiting scroll 24, as is known.

In operation, electrical energization of stator 32 of motor 22 rotatably drives rotor 34 of motor 22 and crankshaft 30 to move orbiting scroll 26 in an orbiting manner with respect to non-orbiting scroll 24. A working fluid, such as a refrigerant, at suction pressure is drawn from suction chamber 38 into suction inlet 66 of non-orbiting scroll 24, and is compressed within the plurality of variable volume, working pockets which are defined between wraps 50 and 62 of fixed and orbiting scrolls 24 and 26, respectively, in a known manner, as orbiting scroll 26. The compressed working fluid is then discharged through discharge outlet 68 in base plate 48 of non-orbiting scroll 24, through discharge check valve assembly 70, and into discharge chamber 42 at a discharge pressure.

Figure 4:
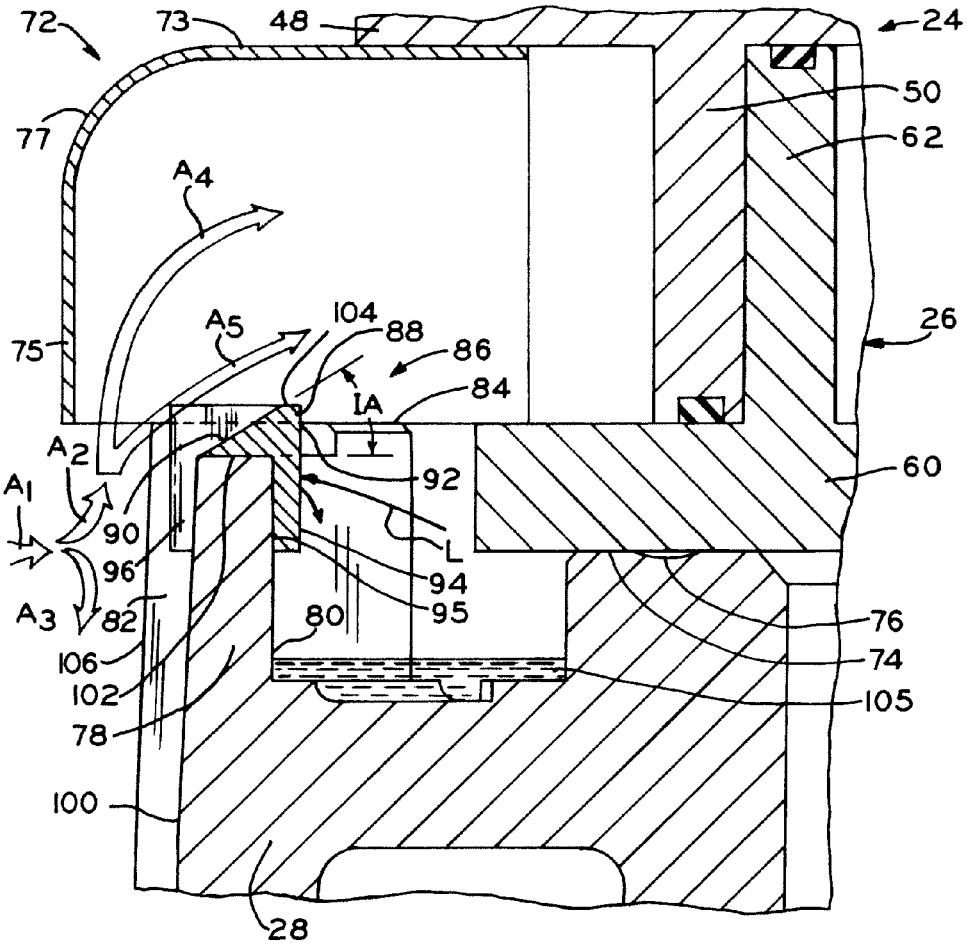
FIG. 4 is a fragmentary, cross-sectional view of the crankcase and baffle member of FIG. 3 taken along line 4-4 of FIG. 3 and further depicting the orbiting scroll and inlet baffle.
Figure 5:
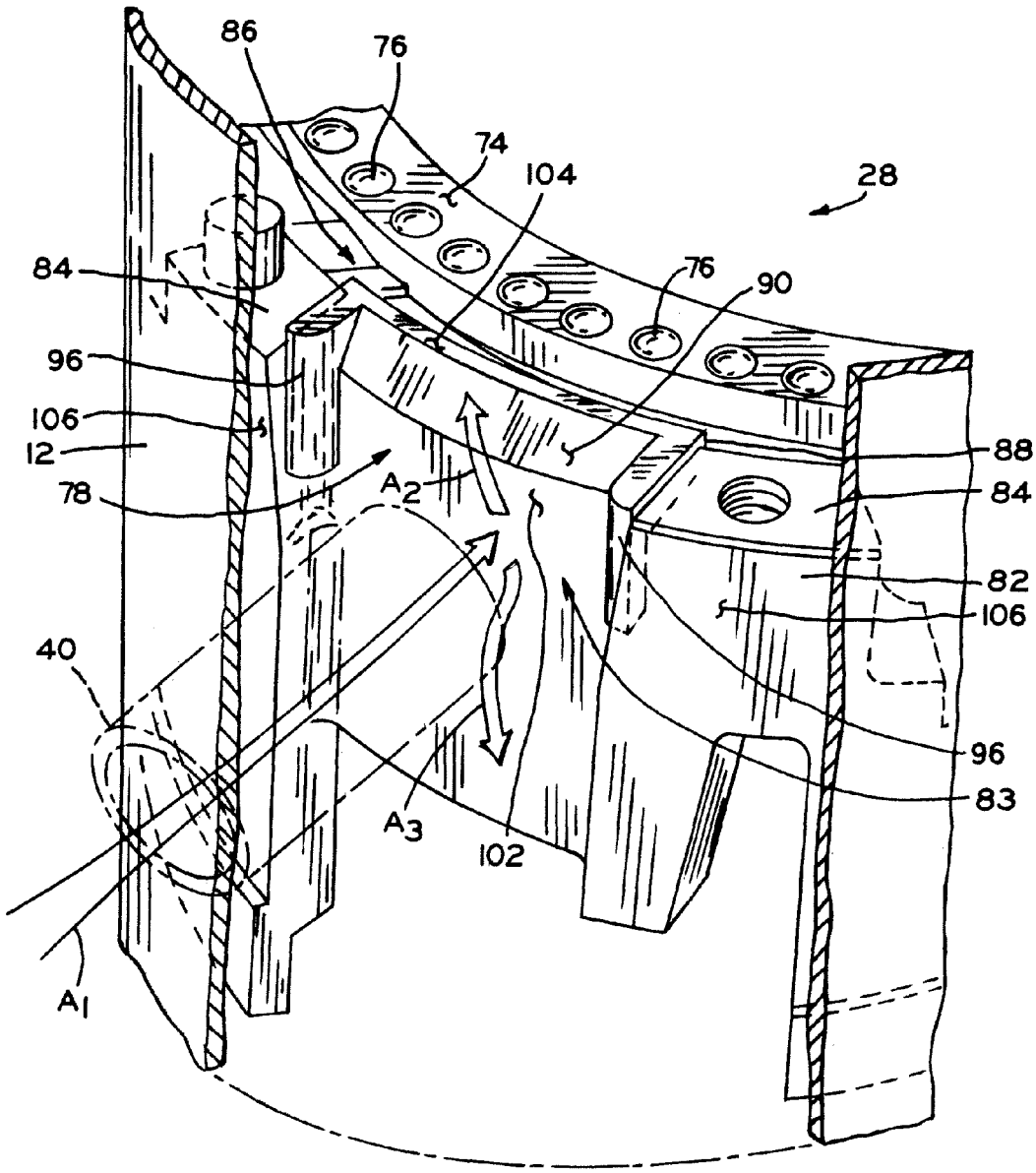
FIG. 5 is a fragmentary perspective view of a portion of the crankcase and the baffle member of FIG. 2 positioned within the compressor housing, depicting the flow of working fluid.
Figure 6:
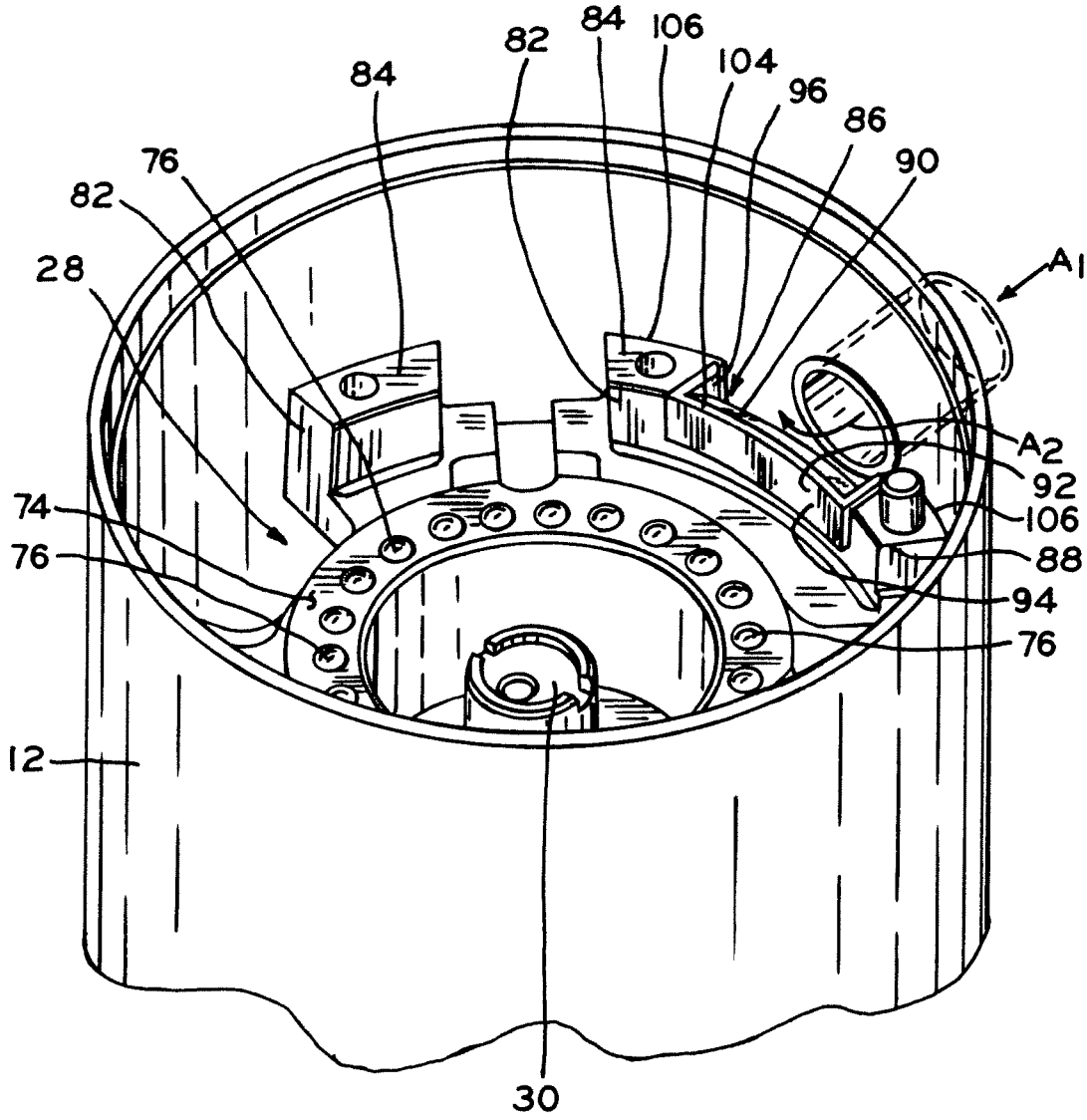
FIG. 6 is another fragmentary perspective view of the crankcase and baffle member of FIG. 5.

More specifically, referring to FIGS. 1, 4, and 5, working fluid at suction pressure enters suction chamber 38 via suction port 40 and initially impinges upon crankcase 28 as it travels in the direction of arrow $A_1$. Thereafter, a portion of the working fluid flows upwardly within suction chamber 38, as designated by arrow $A_2$ in FIG. 5, while the remaining portion of working fluid flows downwardly within suction chamber 38, as designated by arrow $A_3$ in FIG. 5. Referring to FIG. 4, in one exemplary embodiment, a portion of the suction pressure working fluid may travel in the direction of arrow $A_4$, where it contacts inlet baffle 72 secured to non-orbiting scroll 24, which functions to direct the flow of working fluid into suction inlet 66 of orbiting scroll 26. A portion of the working fluid may also flow in the direction of arrow $A_5$ and contact baffle member 86, which directs the flow of working fluid as described in detail below.

Referring to FIG. 4, inlet baffle 72 includes radial wall 73 extending in the radial direction toward main housing 12 and axial wall 75 extending in the axial direction along the inner surface of main housing 12. Radial wall 73 and axial wall 75 of inlet baffle 72 are connected by radiused portion 77 of inlet baffle 72, which also includes a pair of opposing side wall (not shown), with the foregoing walls defining an open end of inlet baffle 72 that faces downwardly in the axial direction. As suction pressure working fluid flows upwardly within suction chamber 38 along arrow $A_4$ in FIG. 4, the working fluid is directed and channeled by inlet baffle into suction inlet 66 of non-orbiting scroll 24. Additional details regarding the construction of operation of inlet baffle 72 are set forth in U.S. patent application Ser. No. 11/679,337, entitled SUCTION BAFFLE FOR SCROLL COMPRESSORS, filed Feb. 27, 2007, and assigned to the assignee of the present invention, the entire disclosure of which is expressly incorporated by reference herein. While compressor 10 is shown and described herein as including inlet baffle 72, inlet baffle is optional, and compressors that lack inlet baffle 72 may still include baffle member 86 that is associated with crankcase 28 and described in detail below.

During orbital movement of orbiting scroll 26, orbiting scroll 26 is supported by thrust surface 74 of crankcase 28. Due to the forces experienced at thrust surface 74 during orbital movement of orbiting scroll 26, particularly during relatively high operating speeds of the compressor, a relatively large amount of lubricant may be needed between base plate 60 of orbiting scroll 26 and thrust surface 74 of crankcase 28 to facilitate the orbital movement of orbiting scroll 26. To contain and accommodate a relative higher amount of lubricant, thrust surface 74 of crankcase 28 may include a plurality of recesses, such as recesses 76, shown more clearly in FIG. 2. Recesses 76 may be substantially similar to, and formed in a similar manner as, the recesses described in detail in U.S. Pat. No. 6,537,045, entitled ROTATING MACHINE HAVING LUBRICANT-CONTAINING RECESSES ON A BEARING SURFACE, issued on Mar. 25, 2003 and assigned to the assignee of the present invention, the entire disclosure of which is expressly incorporated by reference herein. Recesses 76 provide for the accumulation and retention of lubricant on thrust surface 74 and facilitate the formation and maintenance of a lubricant film between thrust surface 74 and base plate 60 of orbiting scroll 26 during operation of the compressor.

However, when compressor 10 is operating, particularly at high speeds, a portion of the lubricant received within recesses 76 and atop thrust surface 74 may be thrown radially outwardly from thrust surface 74 toward the inner surface of main housing 12 of compressor 10. In this manner, because the working fluid flows upwardly past thrust surface 74 as shown by arrow $A_4$ in FIG. 4, a portion of the lubricant that is thrown radially outwardly from thrust surface 74 could be potentially be entrained within this flow of working fluid.

Figure 2:
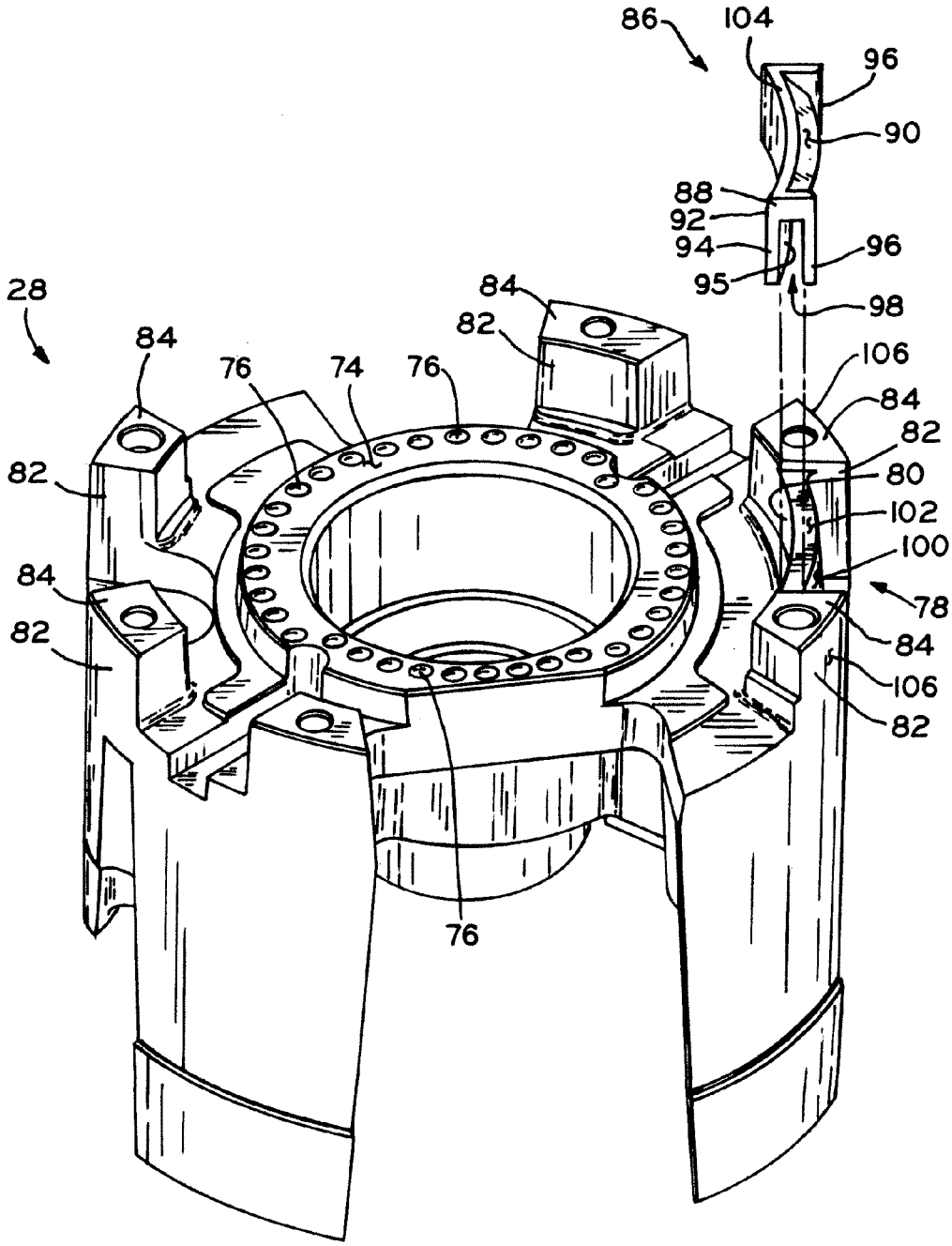
FIG. 2 is an exploded perspective view of the crankcase and baffle member of the scroll compressor of FIG. 1.
Figure 3:
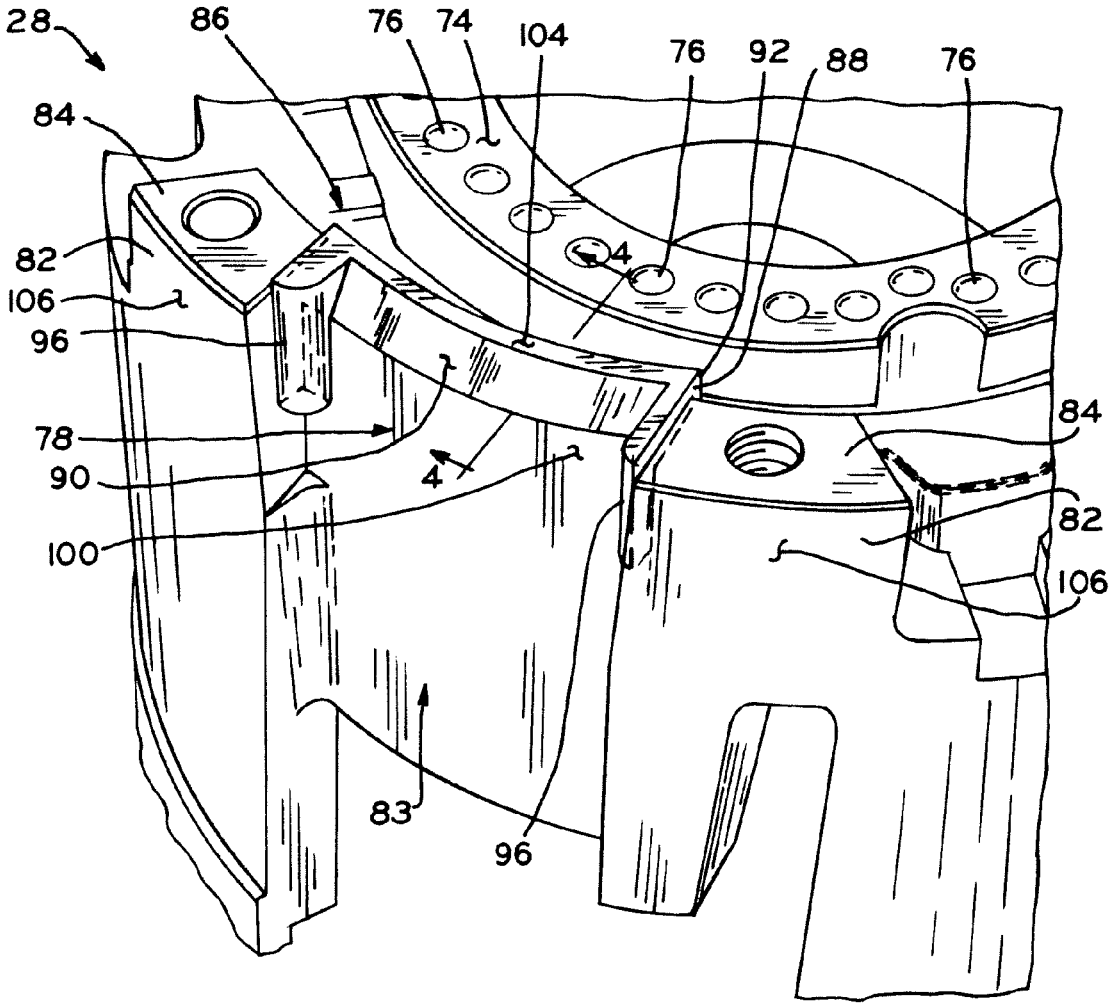
FIG. 3 is a fragmentary perspective view of a portion of the crankcase with the baffle member fitted to the crankcase.

Referring to FIG. 2, the suction pressure working fluid flows axially upwardly over rib 78 of crankcase 28 before it enters suction inlet 66 of non-orbiting scroll 24 (FIG. 1). Lubricant thrown radially outwardly from thrust surface 74 may contact the inner surface 80 of rib 78 of crankcase 28, which may extend to a height in an axial direction that is greater than a thrust surface height TSH (FIG. 1), i.e., the height of thrust surface 74 as measured from the lowermost portion of bottom cap 14 of the compressor. However, a portion of the lubricant could potentially pass over rib 78 of crankcase 28 and become entrained in the suction pressure working fluid traveling to suction inlet 66 of non-orbiting scroll 24.

As shown in FIGS. 2 and 5, rib 78 of crankcase 28 extends between a pair of adjacent leg members 82 of crankcase 28. Leg members 82 include mounting faces 84 that include apertures sized for receipt of fasteners to secure crankcase 28 to non-orbiting scroll 24 (FIG. 1), as described above. Additionally, as shown in FIG. 5, a pair of leg members 82 extends along either side of suction port 40 to help direct suction pressure working fluid toward suction inlet 66 of non-orbiting scroll 24. Specifically, in one exemplary embodiment, outer surface 106 of leg members 82 either contact, or are disposed closely adjacent, the inner surface of main housing 12, and a channel 83 is defined between leg members 82, the inner surface of main housing 12, and the body of crankcase 28. As working fluid travels through suction port 40 and enters main housing 12, the working fluid is directed through channel 83 in the direction of arrows $A_2$ and $A_3$, as described above.

In order to reduce the potential for lubricant becoming entrained in the flow of suction pressure working fluid traveling to suction inlet 66 of non-orbiting scroll 24 and to help direct the flow of suction pressure working fluid into suction inlet 66 of non-orbiting scroll 24, a removeable baffle member 86, shown in FIG. 2, is provided.

Referring to FIG. 5, baffle member 86 is fitted to rib 78 of crankcase 28 as described below, and is disposed radially between thrust surface 74 of crankcase 28 and suction port 40 of main housing 12. Returning to FIG. 2, in one exemplary embodiment, baffle member 86 has a generally curved or arcuate profile, and includes body portion 88 having an arcuate and inclined surface 90 and an arcuate and inwardly radially-facing deflection surface 92.

Referring to FIG. 2, in one exemplary embodiment, baffle member 86 further includes wall 94 and legs 96, both of which extend downwardly from body portion 88 of baffle 86. Legs 96, wall 94, and body portion 88 of baffle member 86 cooperate to respectively define a pair of substantially U-shaped slots 98. Slots 98 are sized to receive rib 78 of crankcase 28 therein. Specifically, as shown in FIGS. 3-6, baffle member 86 is shown positioned atop rib 78 of crankcase 28. Referring to FIGS. 4 and 5, in this position, arcuate inner surface 80 of rib 78 is in substantially flush alignment with interior surface 95 of wall 94 of baffle member 86 and legs 96 of baffle member 86 extend downwardly along outer surface 100 of rib 78 to retain baffle member 86 on support surface 102 of rib 78. In one exemplary embodiment, as shown in FIG. 5, legs 96 of baffle member 86 are curved or radiused to minimize interference with the flow of working fluid through the channel defined between leg members 82 of crankcase 28, such that the likelihood of legs 96 creating turbulence in the working fluid is substantially reduced.

Additionally, when baffle member 86 is positioned on rib 78 of crankcase, body portion 88 of baffle member 86 extends above support surface 102 of rib 78. Specifically, baffle member 86 and, more specifically, upper surface 104 of body portion 88 thereof, is disposed at a baffle member height BH (FIG. 1) in the axial direction, that is higher than thrust surface height TSH. As a result of this added height AH (FIGS. 1 and 4) by which body portion 88 of baffle member 86 extends above support surface 102 of rib 78, an additional barrier to lubricant becoming entrained in suction pressure working fluid traveling from suction port 40 to suction inlet 66 is provided.

Specifically, as illustrated by arrow L in FIG. 4, lubricant thrown radially from thrust surface 74 contacts deflection surface 92 of body portion 88 of baffle member 86 and is deflected, causing it to travel downwardly along wall 94 of baffle member 86 into a lubricant well 105 between rib 78 and thrust surface 74 of crankcase 28. In this manner, lubricant thrown radially from thrust surface 74 is prevented from being entrained into the flow of the working fluid represented by arrows $A_1$, $A_2$, $A_3$, $A_4$, and $A_5$ in FIG. 4. Further, the amount of additional height AH provided by body portion 88 of baffle member 86 may be modified, i.e., increased or decreased, as needed by adjusting the axial height of body portion 88.

Figure 4A:
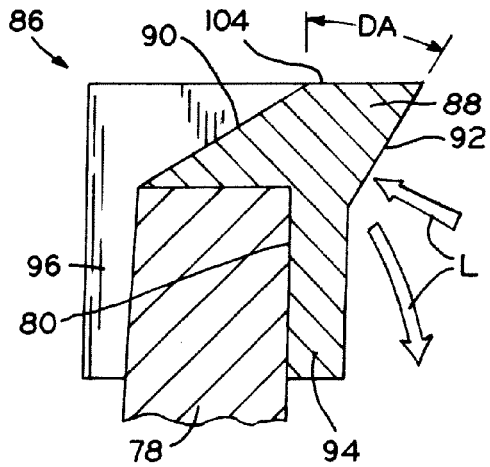
FIG. 4A is an enlarged fragmentary view of a portion of FIG. 4, depicting a baffle member according to another embodiment.
Figure 4B:
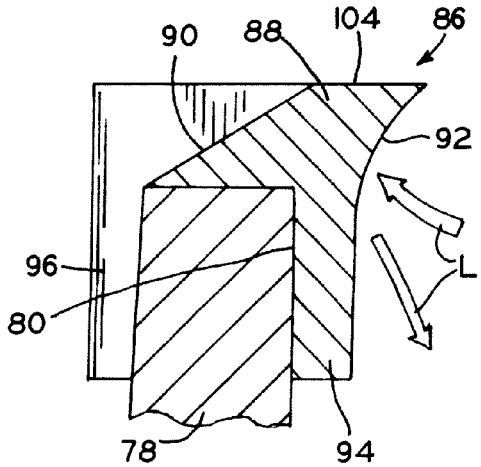
FIG. 4B is an enlarged fragmentary view of a portion of FIG. 4, depicting a baffle member of a further embodiment.

In other exemplary embodiment, shown in FIGS. 4A and 4B, deflection surface 92 of body portion 88 may be modified to further facilitate the deflection of lubricant thrown from thrust surface 74 into lubricant well 105. Referring to FIG. 4A, deflection surface 92 of body portion 88 may be angled with respect to inner surface 80 of rib 78. As shown in FIG. 4A, a deflection angle DA is defined between inner surface 80 of rib 78 and deflection surface 92 of body portion 88 of baffle member 86. Alternatively, referring to FIG. 4B, deflection surface 92 of body portion 88 of baffle member 86 has an axial curvature such that deflection surface 92 is concave in an inwardly radially-facing direction. The modified deflection surfaces 92 shown in FIGS. 4A and 4B aid in directing lubricant that contacts deflection surface 92 of body portion 88 axially downwardly and into lubricant pit 105.

Referring to FIG. 4, inclined surface 90 of baffle member 86 is positioned above rib 78 of crankcase 28 and is inclined in a direction facing the flow of suction pressure working fluid. As shown in FIG. 4, working fluid passing near baffle member 86, represented by arrow $A_5$, contacts baffle member 86 and is directed along inclined surface 90 toward suction inlet 66 of non-orbiting scroll 24, which tends to preserve a more laminar flow of working fluid over baffle member 86 and reduce the tendency for generation of turbulent flow as the working fluid transitions from a substantially vertical flow, represented by arrow $A_2$, to a substantially horizontal flow, represented by arrows $A_4$ and $A_5$.

In exemplary embodiments, inclined surface 90 extends from a point that is substantially coplanar with support surface 102 of rib 78 and terminates at a point that is spaced vertically from support surface 102 of rib 78 by added height AH. Additionally, inclined surface 90 may extend between inner surface 80 and outer surface 100 of rib 78. As shown in FIG. 4, inclined surface 90 defines an inclination angle IA relative to horizontal support surface 102 of rib 78. In exemplary embodiments, inclination angle IA may be as small as 20, 25, 30, 35, 40, or 45 degrees and may be as large as 50, 55, 60, 65, 70, 75, or 80 degrees. In one exemplary embodiment, inclination angle IA is equal to substantially 45 degrees. By adjusting inclination angle IA, the flow characteristics of the working fluid over baffle 86 may be varied.

Advantageously, by using baffle member 86, the potential for lubricant that is radially thrown from thrust surface 74 to become entrained in the flow of suction pressure working fluid is substantially reduced or eliminated. Additionally, the use of baffle member 86 also improves the efficiency of compressor 10 by aiding to direct the flow of suction pressure working fluid into suction inlet 66 of non-orbiting scroll 24.

Furthermore, by providing baffle member 86 as a removable component capable of independent assembly to crankcase 28, a single design of crankcase 28 may be used with multiple configurations of compressor 10 and baffle member 86 may be added only when the additional benefits provided by baffle member 86 are desired. For example, in a variable speed compressor that may operate at relatively high speeds, the velocity of the lubricant and/or amount of lubricant that is thrown from thrust surface 72 may be relatively great and the use of baffle member 86 may be desirable. In contrast, in a single speed compressor that is operated at a substantially low speed, the velocity of the lubricant and/or the amount of lubricant that is thrown from thrust surface 72 may be relatively less and baffle member 86 may not be needed. This modularity reduces manufacturing costs by allowing a single crankcase 28 to be used with multiple compressor configurations and decreases the overall manufacturing cost by eliminating the need to tool and manufacture crankcases 28 of different designs.

While the baffle member of the present invention is described in detail with specific reference to crankcase 28 and compressor 10, the baffle member of the present invention may be used in conjunction with other compressor and/or crankcase designs. Additionally, while this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vertical scroll compressor defining perpendicular axial and radial directions, comprising:

a housing having a suction port;

a compression mechanism disposed within said housing and including a non-orbiting scroll having a first involute wrap and an orbiting scroll having a second involute wrap;

a motor drivingly connected to said orbiting scroll;

a crankcase including a thrust surface disposed at an axial thrust surface height, said thrust surface having a plurality of lubricant retaining recesses formed therein and said orbiting scroll bearingly supported on said thrust surface; and a baffle member removably positioned on said crankcase and disposed radially between said thrust surface and said suction port, said baffle member having a body portion with an upper surface disposed at an axial baffle member height, said baffle member height being greater than said thrust surface height, whereby said baffle member extends above said thrust surface of said crankcase.

2. The vertical scroll compressor of claim 1, wherein said baffle member further comprises a deflection surface facing radially inwardly toward said thrust surface.

3. The vertical scroll compressor of claim 2, wherein said deflection surface is one of:

angled with respect to said axial direction; and concavely shaped with respect to said axial direction.

4. The vertical scroll compressor of claim 1, wherein said crankcase further comprises at least a pair of spaced leg members secured to said motor, said baffle member positioned between a pair of said leg members.

5. The vertical scroll compressor of claim 4, wherein said crankcase further comprises a rib disposed between said leg members, said baffle member positioned on said rib.

6. The vertical scroll compressor of claim 5, wherein said rib further comprises an outer surface and an inner surface, said baffle member including an inclined surface extending between said outer surface and said inner surface of said rib.

7. The vertical scroll compressor of claim 1, wherein said crankcase further comprises a lubricant well disposed radially between said thrust surface and said baffle member.

8. The vertical scroll compressor of claim 1, wherein said upper surface of said body portion of said baffle member defines an inclined surface, said inclined surface terminating at a point that is spaced axially above said crankcase.

9. The vertical scroll compressor of claim 8, wherein said inclined surface of said body portion of said baffle member extends from a point that is substantially coplanar with said crankcase.

10. A vertical scroll compressor defining perpendicular axial and radial directions, comprising:

a housing having a suction port;

a compression mechanism disposed within said housing and including a non-orbiting scroll having a first involute wrap and a suction inlet, and an orbiting scroll having a second involute wrap;

a motor drivingly connected to said orbiting scroll;

a crankcase including a thrust surface disposed at an axial thrust surface height, said orbiting scroll bearingly supported on said thrust surface; and a baffle member removably positioned on said crankcase and disposed radially between said thrust surface and said suction port, said baffle member having a body portion including an inclined surface disposed at least partially axially above said crankcase, said inclined surface facing a flow path of working fluid from said suction port to said suction inlet.

11. The vertical scroll compressor of claim 10, wherein said crankcase includes at least a pair of spaced leg members secured to said motor, said baffle member positioned on a support surface of said crankcase that is disposed between a pair of said leg members.

12. The vertical scroll compressor of claim 11, wherein said inclined surface of said baffle member defines an inclination angle relative to said support surface of said crankcase, said inclination angle between 20 degrees and 80 degrees.

13. The vertical scroll compressor of claim 11, wherein said crankcase, said leg members, and said housing together define an axially extending channel, said channel facing said suction port.

14. The vertical scroll compressor of claim 13, further comprising an inlet baffle secured to said non-orbiting scroll, said inlet baffle including an axially-facing open end aligned with said channel.

15. The vertical scroll compressor of claim 11, wherein said support surface is formed as a rib having an outer surface and an inner surface, said inclined surface extending between said outer surface and said inner surface of said rib.

16. The vertical scroll compressor of claim 15, wherein said baffle member defines at least one substantially U-shaped slot, said substantially U-shaped slot configured to receive at least a portion of said rib of said crankcase therein to mount said baffle member on said support surface of said rib.

* * * * *